US007426808B2

(12) United States Patent
Sanger

(10) Patent No.: US 7,426,808 B2
(45) Date of Patent: Sep. 23, 2008

(54) METHOD OF FORMING CONCRETE BUILDING MODULES

(76) Inventor: Wallace D. Sanger, 11333 Acme Rd., West Palm Beach, FL (US) 33414

( * ) Notice: Subject to any disclaimer, the term of this patent is extended or adjusted under 35 U.S.C. 154(b) by 1515 days.

(21) Appl. No.: 09/776,005

(22) Filed: Feb. 2, 2001

(65) Prior Publication Data

US 2002/0104272 A1 Aug. 8, 2002

(51) Int. Cl.
*E04G 11/36* (2006.01)
*E04G 21/02* (2006.01)

(52) U.S. Cl. ..... 52/742.14; 52/236.5; 52/250; 52/745.2; 264/31; 264/35

(58) Field of Classification Search ..... 52/745, 52/742.1, 742.14, 250, 251, 79.9, 236.5; 264/31, 35

See application file for complete search history.

(56) References Cited

U.S. PATENT DOCUMENTS 3,765,543 A * 10/1973 Thomas ..... 414/11
4,909,001 A * 3/1990 Gonzalez Espinosa de Los Monteros ..... 52/251
5,487,241 A * 1/1996 Gorrell et al. ..... 52/253
5,799,453 A * 9/1998 Westerlund ..... 52/250
6,038,824 A * 3/2000 Hamrick, Sr. ..... 52/143
6,370,835 B1 * 4/2002 Morgan et al. ..... 52/745.05
7,086,209 B1 * 8/2006 Pruitt et al. ..... 52/745.13

OTHER PUBLICATIONS www.cement.ca Oct. 7, 2001.*

* cited by examiner

*Primary Examiner*—Robert Canfield
(74) *Attorney, Agent, or Firm*—Frank L. Kubler

(57) ABSTRACT

A method of constructing a concrete module having several interconnected walls and defining a portion of a building includes the steps of forming two pitch walls, each pitch wall having a wall upper end angled to match the pitch of the building roof to define an upper peak having a beam receiving notch, having a shorter lateral end and a longer lateral end, and a wall lower end [and an angled upper end], and having a notch at the intersection of the lower lateral end and the angled wall upper end; forming a linking wall having two linking wall lateral ends substantially matching the height of the pitch wall shorter lateral ends; providing a floor form platform having a horizontal platform surface and an upright floor form rail defining a side of the floor form; placing the two pitch walls and the linking wall on a floor form platform; pouring uncured concrete into the floor form; permitting the concrete within the floor form to cure and define a module floor jointed to the pitch walls and the linking wall; constructing a roof form with roof form support structures; forming a concrete beam; placing the beam parallel to the linking wall and into beam notches to complete the perimeter wall of the roof form; and pouring uncured concrete into the roof form; permitting the concrete in the roof form to cure; removing the roof form support structures; and lifting the completed module of f the platform.

6 Claims, 11 Drawing Sheets

METHOD OF FORMING CONCRETE BUILDING MODULES

BACKGROUND OF THE INVENTION

1. Field of the Invention

The present invention relates generally to the field of methods for constructing concrete buildings. More specifically the present invention relates to a method of constructing a concrete module having several interconnected walls and defining a portion of a building. The method includes the essential steps of forming two pitch walls, each pitch wall having a wall upper end angled to match the pitch of the building roof to define an upper peak having a beam receiving notch, having a shorter lateral end and a longer lateral end, and a wall lower end, and having a notch at the intersection of the lower lateral end and the angled wall upper end; forming a linking wall having two linking wall lateral ends substantially matching the height of the pitch wall shorter lateral ends; providing a floor form platform having a horizontal platform surface and an upright tubular floor form rail which defines a side of the floor form, placing the two pitch walls and the linking wall on a floor form platform such that the pitch wall longer lateral ends are each abutting and substantially perpendicular to the floor form wall and the pitch wall shorter lateral ends are adjacent to one of the linking wall lateral ends such that the pitch walls both extend in the same direction from and are substantially perpendicular to the linking wall, and the pitch walls, linking wall and floor form wall together enclose a region of the horizontal platform surface to define a floor form; pouring uncured concrete into the floor form; permitting the concrete within the floor form to cure and define a module floor jointed to the pitch walls and the linking wall; constructing a roof form with roof form support structures having planar upper surfaces angled to match the desired roof pitch and to define a contiguous roof form lower wall below a distance below and adjacent to the pitch wall and linking wall upper ends and meeting the pitch walls and linking walls to define a roof form; optionally placing insulating foam blocks on top of the support structures for incorporation into the formed roof; forming a pre/post-stressed concrete beam, placing the beam parallel to the linking wall and into the beam notches; pouring uncured concrete into the roof form; permitting the concrete in the roof form to cure; removing the roof form support structures; lifting the completed module off the platform.

The modules are preferably formed side by side on a special platform having a steel sheet surface and a common platform floor form of a rail. The two modules that will together form a given building are formed closely opposing each other on either side of this rail, so that any slight plumb bob tilt of the module side walls directly corresponds from one module to the other and common side walls are mutually aligned.

2. Description of the Prior Art

There have long been methods of forming buildings from pre-fabricated concrete walls in which the walls are formed at a forming site and transported to a construction site, where they are positioned, tilted up and laterally interconnected at their ends. A problem with these prior methods is that they fall short of teaching how to fabricate a pair of matching, integral concrete building modules from pre-formed concrete walls which can be lifted by a crane.

It is thus an object of the present invention to provide a method of forming a concrete building module in which pre-fabricated building walls become integrally interconnected.

It is another object of the present invention to provide such a method which creates a module which is sufficiently integral and sturdy to be lifted by embedded lifters with a crane.

It is still another object of the present invention to provide such a method which can be practices by workmen of substantially ordinary skill in the art of prefabricating building walls.

It is finally an object of the present invention to provide such a method in which only ordinary, inexpensive and widely available hardware is incorporated into the module to achieve its functional purposes and which generally requires only ordinary and common building tools to fabricate.

SUMMARY OF THE INVENTION

The present invention accomplishes the above-stated objectives, as well as others, as may be determined by a fair reading and interpretation of the entire specification.

A method is provided of constructing a concrete module having several interconnected walls and defining a portion of a building, including the steps of forming two pitch walls, each pitch wall having a wall upper end angled to match the pitch of the building roof to define an upper peak having a beam receiving notch, having a shorter lateral end and a longer lateral end, and a wall lower end, and having a notch at the intersection of the lower lateral end and the angled wall upper end; forming a linking wall having two linking wall lateral ends substantially matching the height of the pitch wall shorter lateral ends; providing a floor form platform having a horizontal platform surface and an upright floor form rail defining a side of the floor form; placing the two pitch walls and the linking wall on a floor form platform such that the pitch wall longer lateral ends are each abutting and substantially perpendicular to the floor form wall and the pitch wall shorter lateral ends are adjacent to one of the linking wall lateral ends such that the pitch walls both extend in the same direction from and are substantially perpendicular to the linking wall, and the pitch walls, linking wall and floor form wall together enclose a region of the horizontal platform surface to define a floor form; pouring uncured concrete into the floor form; permitting the concrete within the floor form to cure and define a module floor jointed to the pitch walls and the linking wall; constructing a roof form with roof form support structures having planar upper surfaces angled to match the desired roof pitch and optionally insulating form blocks on top of the support structures to define a contiguous roof form lower wall below a distance below and adjacent to the pitch wall and linking wall upper ends and meeting the pitch walls and linking walls to define a roof form; forming a pre- or post-stressed concrete beam, or providing an I-beam or other type of beam, placing the beam parallel to the linking wall and into the beam notches; and pouring uncured concrete into the roof form; permitting the concrete in the roof form to cure; removing the roof form support structures; lifting the completed module off the platform.

The method preferably includes the additional steps of forming metal plates into lateral edges of the pitch walls and linking walls; and welding the adjacent metal plates of adjacent lateral ends together to hold the walls in place prior to floor and roof forming. The method preferably includes the additional steps of forming a mitered edge along the pitch wall shorter lateral ends forming a mitered edge along each of the linking wall lateral ends, and placing the shorter pitch wall lateral ends adjacent to the linking wall lateral ends such that pitch wall shorter lateral ends and linking wall lateral ends meet to define mitered corners.

The method step of forming a concrete wall preferably includes the sub-steps of providing three wall forms each having a rectangular perimeter wall resting on a platform; placing reinforcing members within the wall forms, the reinforcing members including threaded first reinforcing rods having threaded rod connection ends such that the threaded rod connection ends are exposed; pouring uncured concrete into the wall forms; permitting the concrete to cure and form building walls; removing the building wall from the wall form; and additionally including the step of fastening second threaded reinforcing rods to the threaded rod connection ends of the first threaded reinforcing rods such that the second threaded reinforcing rods extend laterally into the floor form.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
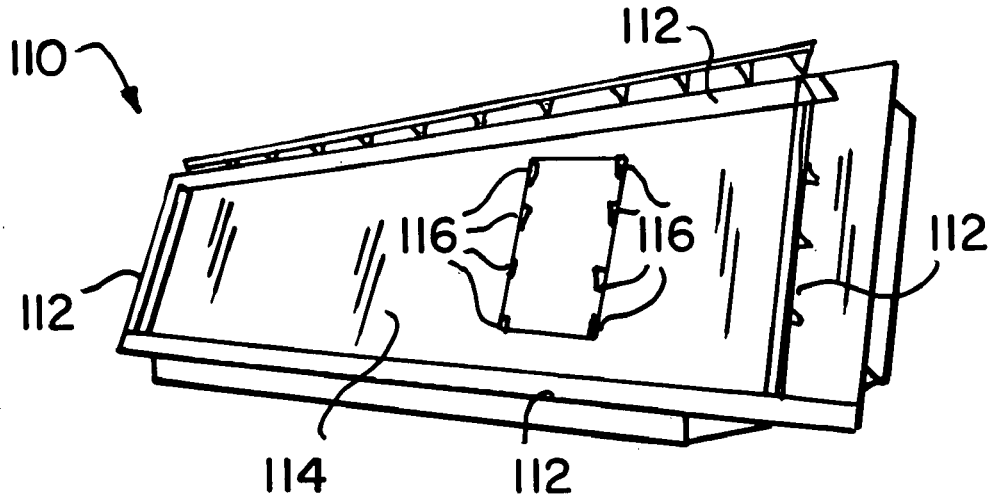
FIG. 1 is a front perspective view of a module side wall form in which the platform is a hydraulic tilting table.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES. are designated by the same reference numerals.

Preferred Method

Figure 15:
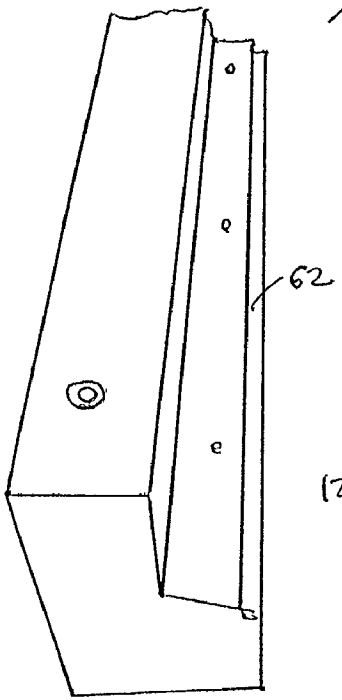
FIG. 15 is a partial perspective view of the FIG. 14 beam.
Figure 14:
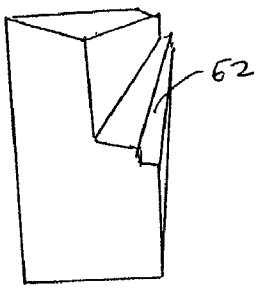
FIG. 14 is a perspective end view of the preferred prestressed beam.
Figure 17:
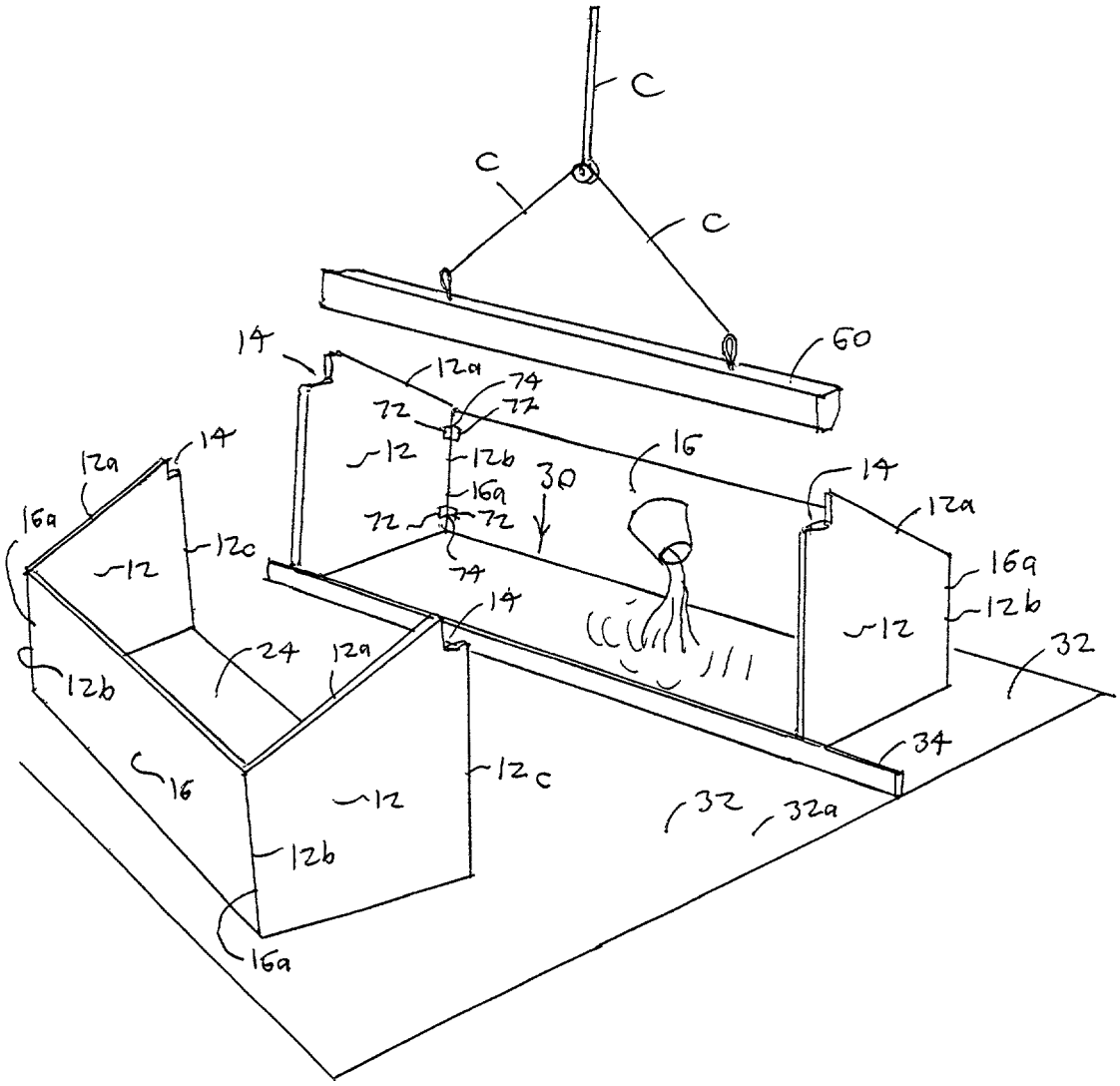
FIG. 17 is a perspective view of two of the modules with the floor of one being poured and the beams being lowered into place by a crane, and with the roofs not yet formed.
Figure 18:
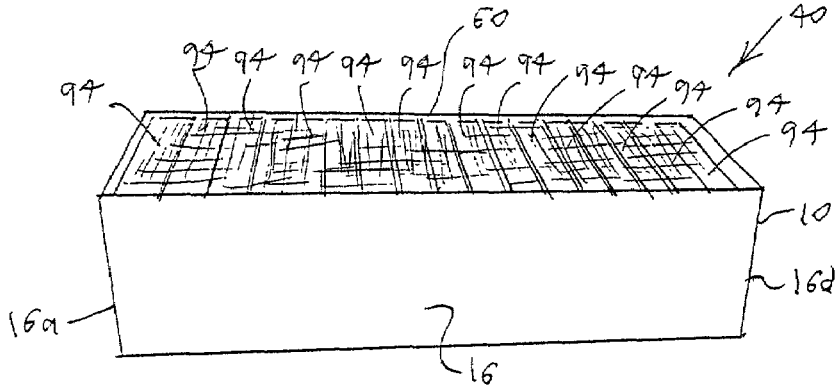
FIG. 18 is an outside side view of a module showing the roof form assembled and filled with insulating foam blocks and reinforcing rods and a net of heavy reinforcing wire.
Figure 19:
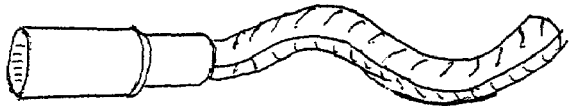
FIG. 19 is a side view of a reinforcing rod preferably embedded in the upper end of the module pitch and linking walls, the tubular end of which having internal threads from removably receiving a lifter for lifting the walls during module construction and for lifting the completed module.
Figure 20:
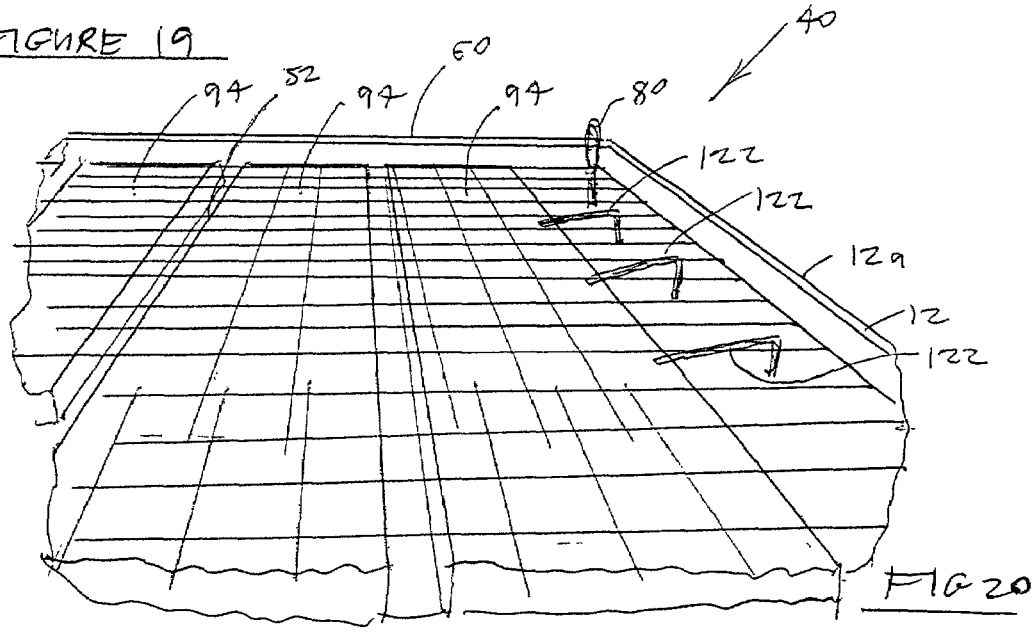
FIG. 20 is a close-up, broken away view of the roof form of FIG. 18, showing in greater detail the insulating foam blocks which are to become formed into and part of the building roof, reinforcing rods and wire, and a lifter in the far corner.
Figure 21:
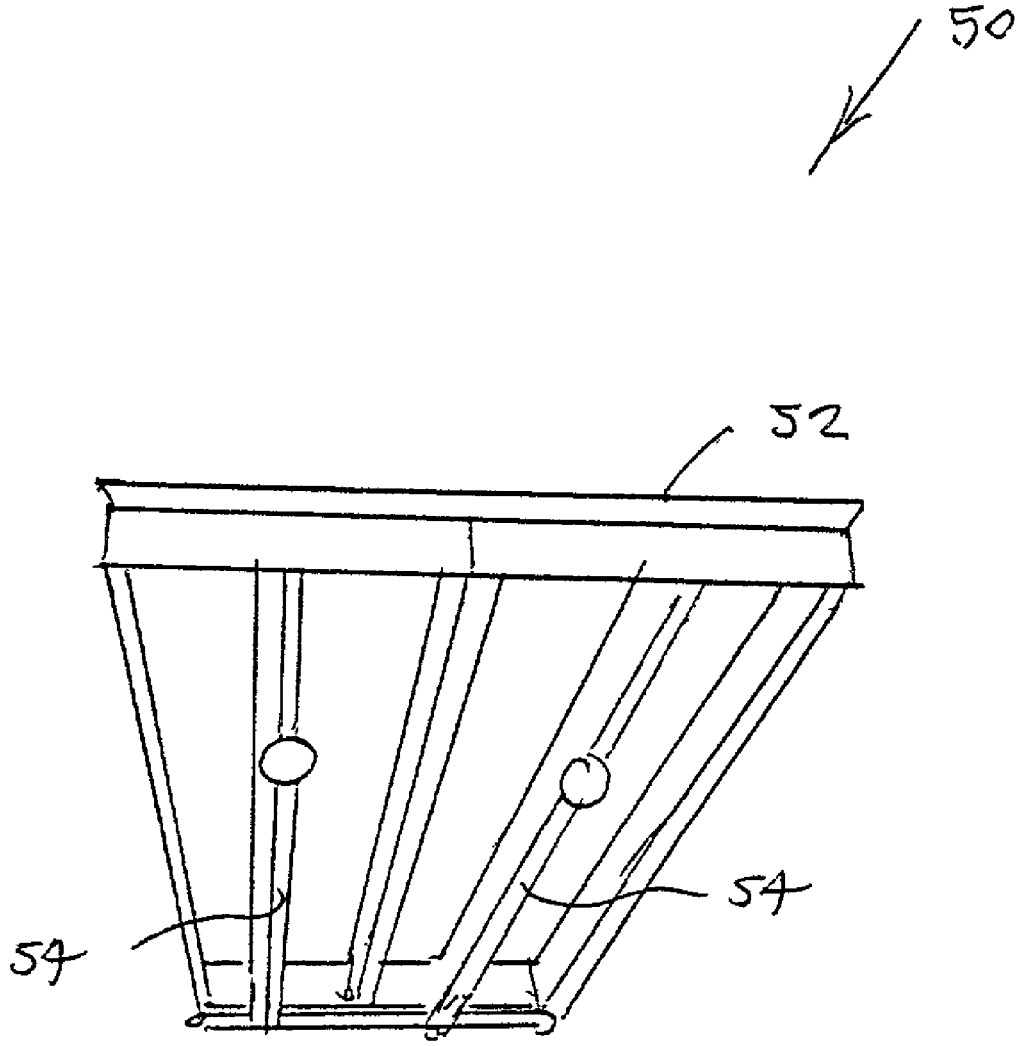
FIG. 21 is a bottom perspective view of one of the roof form support structures.
Figure 23:
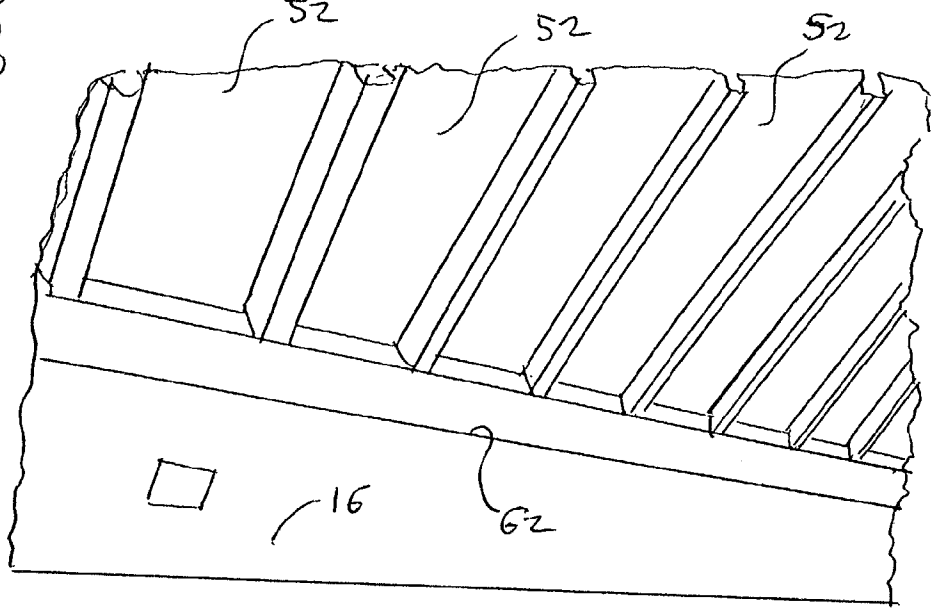
FIG. 23 is a bottom view of the panels of the roof form support structures of FIG. 22 meeting the beam, with a protruding flange of the roof form support structures panels inserted into and resting on the beam lip, at the end of the panels opposite the panel end supported by the roof foam support structure legs.
Figure 22:
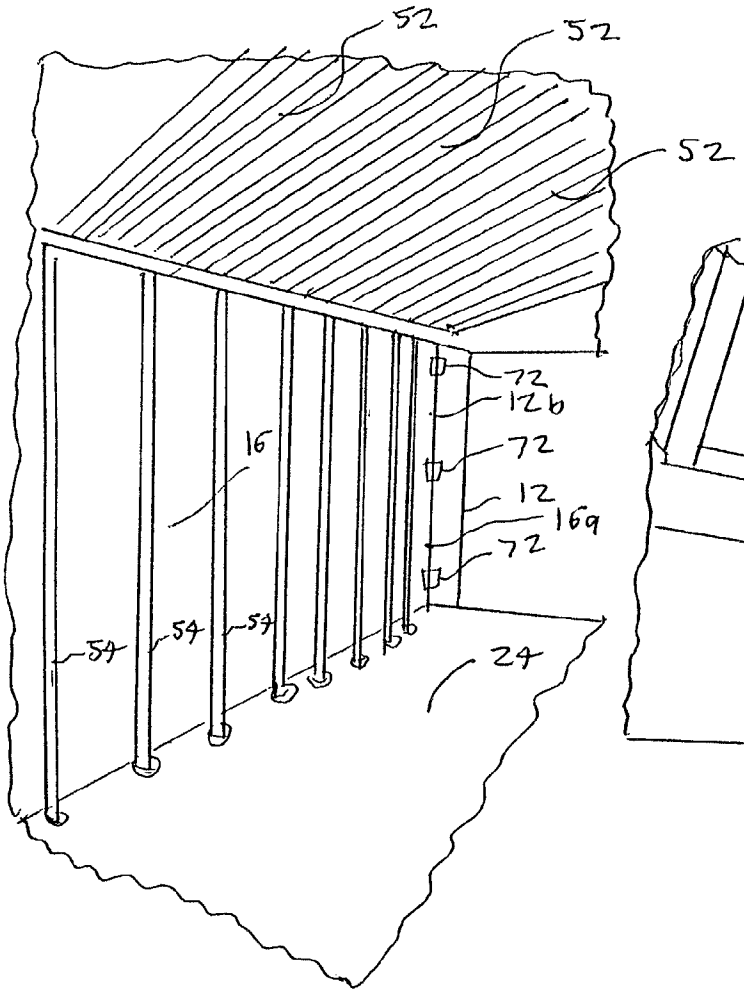
FIG. 22 is broken away, partial, interior perspective view of a building module with the floor already poured and the roof form in place, showing a contiguous series of the roof form support structures.

Referring to FIGS. 1-23, a method of constructing a concrete module 10 having several interconnected walls and defining a portion of a building is disclosed. The method includes the essential steps of forming two pitch walls 12, each pitch wall 12 having a wall upper end 12*a* angled to match the pitch of the building roof 22 to define an upper peak, having a shorter lateral end 12*b* and a longer lateral end 12*c*; and a lower end, and having a beam notch 14 at the intersection of the lateral end 12*b* and the angled upper end 12*a*; forming a linking wall 16 having two linking wall lateral ends 16*a* substantially matching the height of the pitch wall shorter lateral ends 12*b*; providing a floor form platform 32 having a horizontal platform surface 32*a* and an upright tubular floor form rail 34, placing the two pitch walls 12 and the linking wall 16 on a floor form platform 32 such that the pitch wall longer lateral ends 12*b* are each abutting and substantially perpendicular to the floor form rail 34 and the pitch wall shorter lateral ends 12*b* are adjacent to one of the linking wall lateral ends 16*a* such that the pitch walls 12 both extend in the same direction from and are substantially perpendicular to the linking wall 16, and the pitch walls 12, linking wall 16 and floor form rail 34 together enclose a region of the horizontal platform surface 32*a* to define a floor form 30; pouring uncured concrete into the floor form 30; permitting the concrete within the floor form 30 to cure and define a module floor 24 jointed to the pitch walls 12 and the linking wall 16; constructing a roof form 40 with roof form support structure 50 including support structure legs 54 pivotally connected to support structure concrete supporting panels 52 having planar upper panel surfaces angled to match the desired roof pitch and placed together to define a contiguous roof form lower wall 52 a distance below and adjacent to the pitch wall and linking wall upper ends 12*a* and 16*b*, respectively, and meeting the pitch walls 12 and linking walls 16 to define a partial roof form 40 (See FIGS. 18 and 20); forming a pre/post-stressed concrete beam 60, placing the beam 60 parallel to the linking wall 16 and into the beam notches 14 to complete the roof form 40 perimeter side wall (See FIG. 17; pouring uncured concrete into the roof form 40; permitting the concrete in the roof form 40 to cure; removing the roof form support structures 50; lifting the completed module 10 off the platform 32. Concrete supporting panels 52 preferably each have a panel supported end supported by a support structure leg 54 and have a panel engaging end with a beam lip engaging flange 56 protruding outwardly therefrom for resting on a beam lip 62. See FIGS. 14, 15 and 23.

The method preferably includes the additional steps of forming metal plates 72 into lateral edges of the pitch walls 12 and linking walls 16, joining the adjacent metal plates 72 of adjacent lateral ends together with welds 74 to hold the walls 12 and 16 in place prior to floor 24 and roof 22 forming. See FIGS. 4, 12 and 17. A still additional step is that of creating a mitered edge along the pitch wall shorter lateral ends during forming and creating a mitered edge along each of the linking wall lateral ends 16*a* during forming, and placing the pitch wall shorter lateral ends 12*b* adjacent to the linking wall lateral ends 16*a* such that pitch wall shorter lateral ends 120 and linking wall lateral ends 16*a* meet to define mitered corners.

The method preferably still further includes the steps of forming two of the modules 10 side by side on a special platform 32 having a steel sheet surface 32*a* and a common platform floor form rail 34. See FIGS. 5 and 8-10. The two modules 10 that will together form a given building are formed closely opposing each other on either side of form rail 34, so that any slight plumb bob tilt of the module pitch walls 12 directly corresponds from one module 10 to the other and common pitch side walls 12 are mutually aligned.

Figure 2:
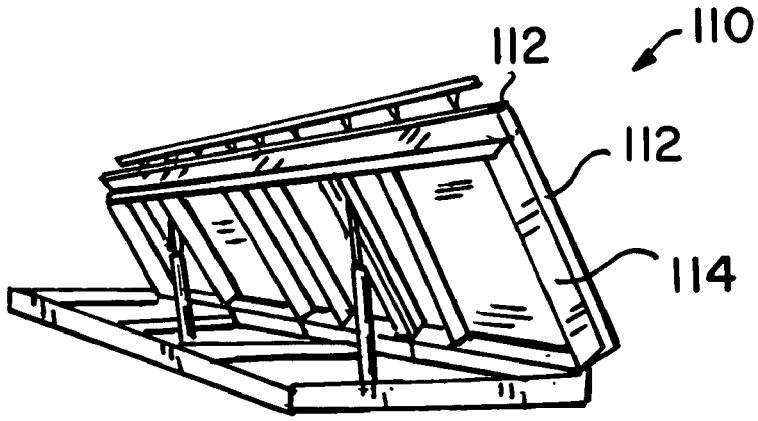
FIG. 2 is a rear perspective view of the wall form tilting table of FIG. 1.
Figure 3:
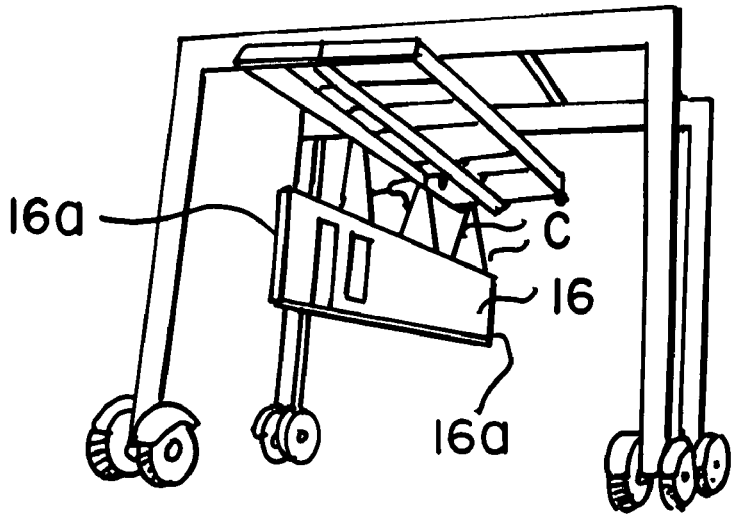
FIG. 3 is a perspective view of a bridge crane carrying a linking wall to a module forming site.
Figure 4:
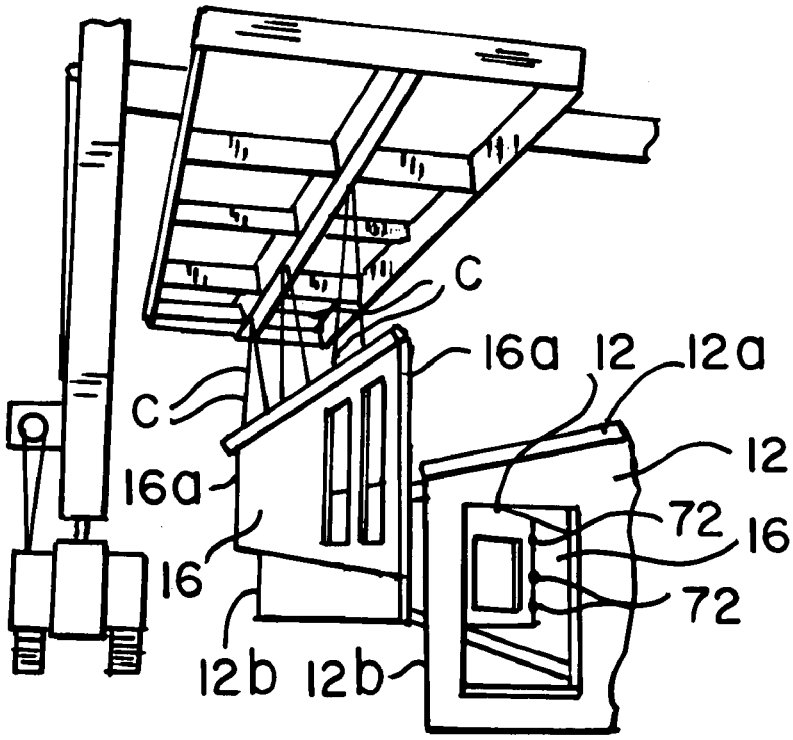
FIG. 4 is a perspective view of the bridge crane of FIG. 3 lowering the linking wall into place to complete the sides of a module resting on a floor forming platform opposite another module.
Figure 5:
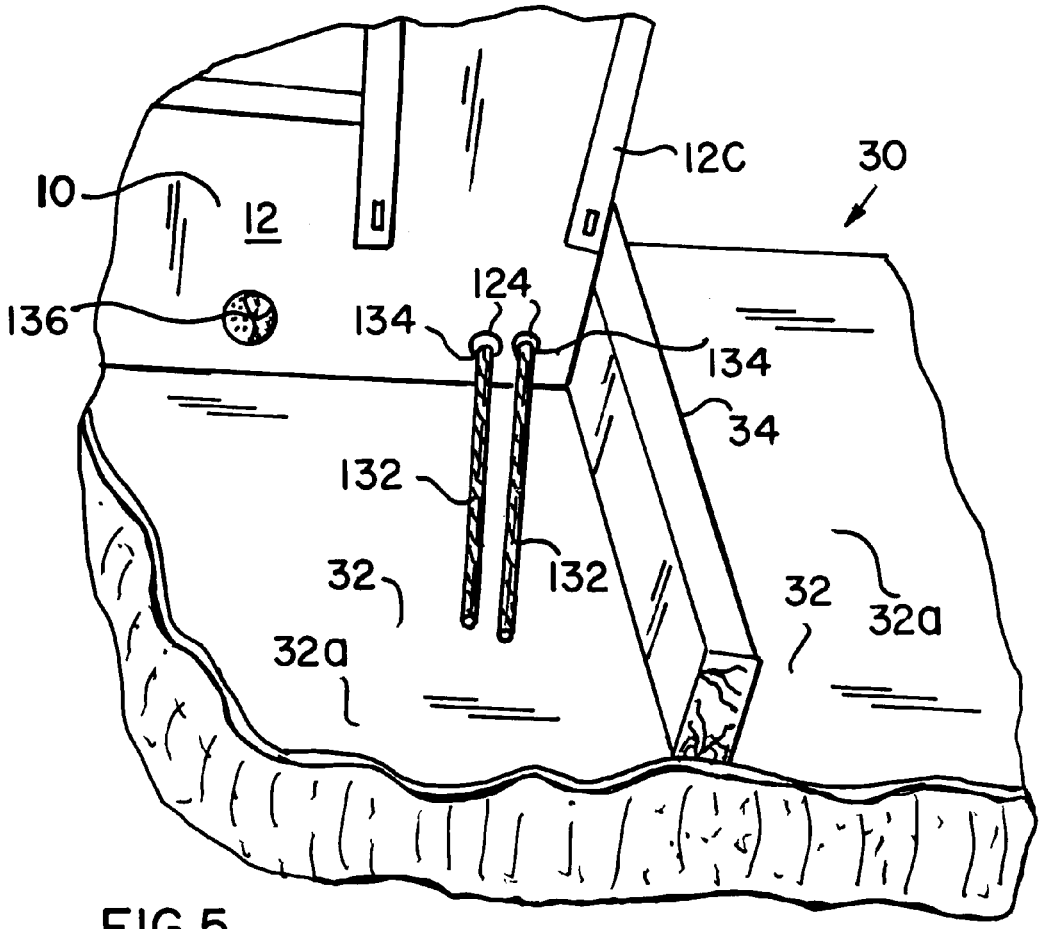
FIG. 5 is a broken away perspective view of part of a module floor form showing the preferred rail defining part of the perimeter side wall of a floor form and separating the two opposing modules, and showing the second threaded reinforcing rods screwed into the female threaded ends of embedded first threaded reinforcing rods.
Figure 6:
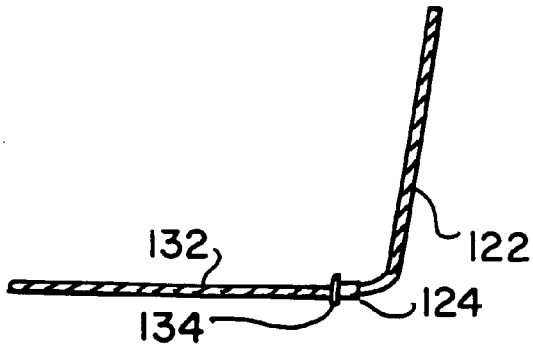
FIG. 6 is a side view of interconnected first and second threaded reinforcing rods.
Figure 7:
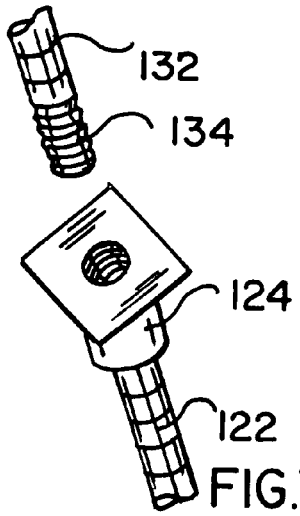
FIG. 7 is a partial perspective view of the threaded ends of the first and second threaded reinforcing rods positioned for interconnection.
Figure 9:
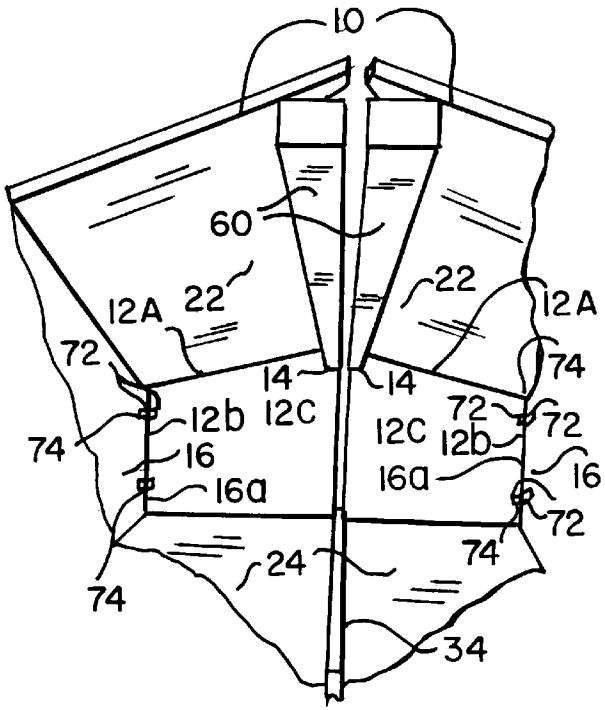
FIG. 9 is an interior perspective view of two modules to together define a building, the modules being formed opposite each other along their common floor form rail so that any slight eccentricity of the upright positioning of the pitch walls matches.
Figure 8:
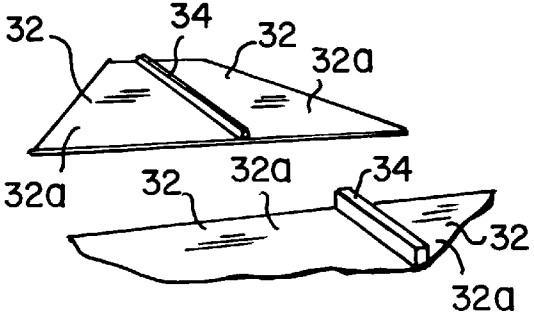
FIG. 8 is broken away view of a complete floor form and a partial floor form platform with floor form upright rails fastened along the middle of the platforms.
Figure 11:
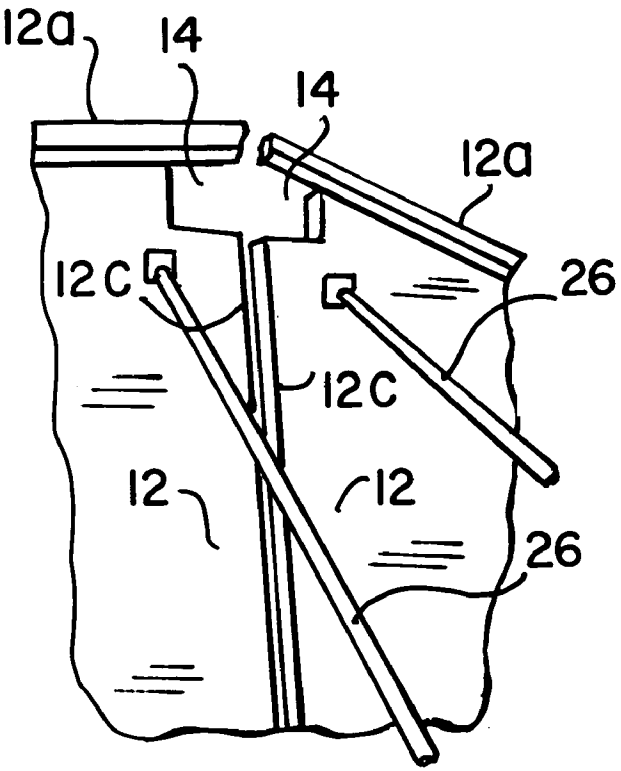
FIG. 11 is an outside partial perspective view of two corresponding pitch walls of adjacently formed modules set into place and braced upright with side wall support braces 26.
Figure 10:
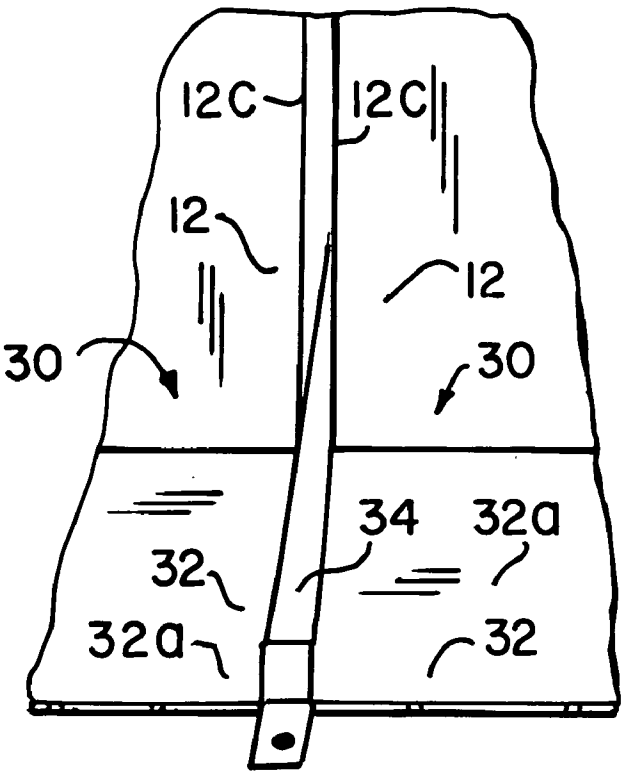
FIG. 10 is a broken away partial perspective view of the floor form rail running between two opposing modules.
Figure 12:
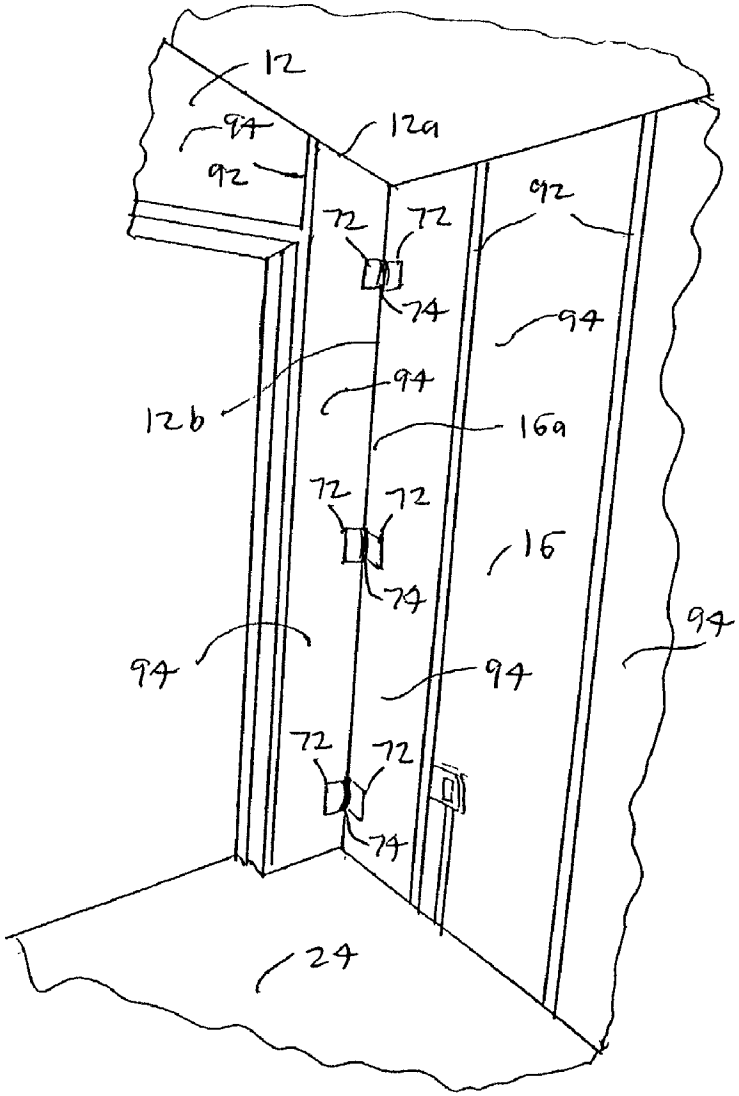
FIG. 12 is a broken away partial interior perspective view of a building module, showing the metal plates welded together to interconnect pitch and linking walls prior to floor and roof pours.
Figure 13:
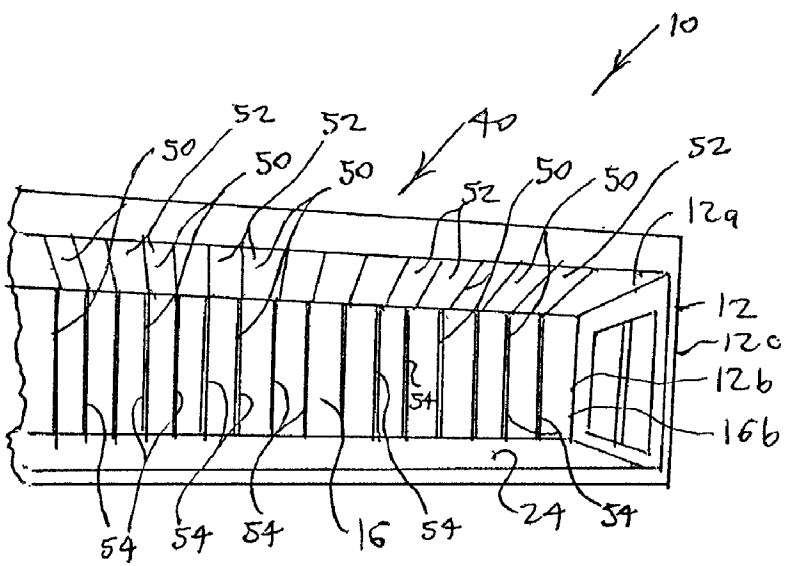
FIG. 13 is perspective interior view of a building module, showing the contiguous series of roof form support structures in place to complete the roof form.
Figure 16:
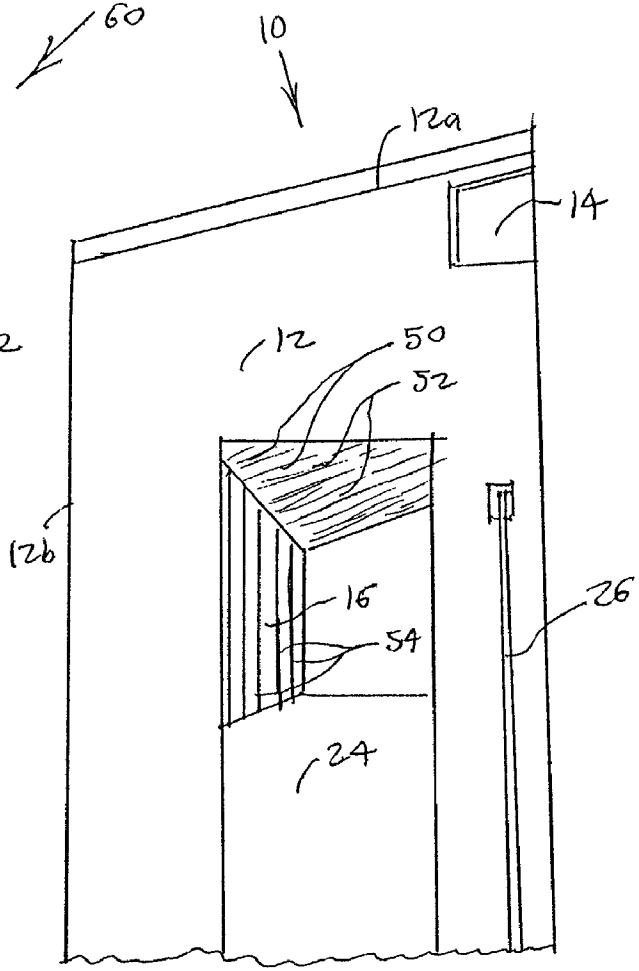
FIG. 16 is an outside partial side view of a module, with the roof form support structures visible through a doorway in the pitch wall in the foreground.

The step of forming a concrete pitch and linking wall 12 or 16, respectively, includes the sub-steps of providing three wall forms 110 each having a rectangular perimeter wall 112 resting on a platform 114; placing reinforcing members within the wall forms 110, the reinforcing members including threaded first reinforcing rods 122 having threaded rod connection ends 124 such that the threaded rod connection ends 124 are exposed; pouring uncured concrete into the wall forms 110; permitting the concrete to cure and form building walls 12 and 16; removing the building wall from the wall form; and additionally including the step of fastening second threaded reinforcing rods 132 to the threaded rod connection ends 134 of the first threaded reinforcing rods 122 such that the second threaded reinforcing rods 132 extended laterally into the floor form 30, and optionally into the roof form 40. See FIGS. 5-7. Wall form platforms 114 are preferably hydraulically tiltable tables as shown in FIGS. 1 and 2. Concrete receiving recesses 136 are preferably provided in the lower ends of pitch walls 12 and linking wall 16 at a level that uncured concrete flows into the recesses 136 when the floor 24 is poured, to increase interconnectedness and module strength and integrity. The wall upper ends are preferably formed with embedded and upwardly protruding lifters 80 or lifter mounts so that the walls 12 and 16 can be lifted by crane cables C into their permanent positions relative to each other to define a module 10. See FIGS. 3 and 4.

The steps of wall 12 and 16, floor 24 and roof 22 forming preferably include the steps of placing insulating foam and metal or plastic studs into the forms prior to the uncured concrete pour. Details of foam and stud placement are provided in U.S. Pat. No. 5,313,753, issued on May 24, 1994 and U.S. Pat. No. 5,382,635, issued on Jan. 17, 1995, both of which were issued to the present inventor/applicant. Insulating foam blocks are preferably placed on top of roof form support structure planar surfaces, which become incorporated into the module roof 22 as well as help the roof form bottom wall against passage of uncured concrete.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of constructing a concrete module, comprising the steps of:

forming a first pitch wall and a second pitch wall, each of said first and second pitch walls having a wall upper end and having a pitch wall first lateral end and a pitch wall second lateral end and a wall lower end;

forming a linking wall having two linking wall lateral ends;

providing a floor form platform having a horizontal platform upper surface and an upright floor form rail extending upwardly from said platform surface and having a longitudinal rail side;

placing said first and second pitch walls and said linking wall on the horizontal platform upper surface of said floor form platform such that the pitch wall second lateral ends of said first and second pitch walls are each adjacent to said longitudinal rail side and the pitch wall first lateral ends of said first and second pitch walls are adjacent to said linking wall such that said first and second pitch walls both extend generally in the same direction from said linking wall and are spaced apart from each other, and said first and second pitch walls, said linking wall and said longitudinal rail side of said floor form rail together enclosing a region of said horizontal platform surface to define a floor form;

pouring uncured concrete into said floor form;

permitting the concrete within said floor form to cure and define a module floor joined to said first and second pitch walls and said linking wall, such that said module floor, said first and second pitch walls and said linking wall together define a module;

and removing the completed module from said platform.

2. A method of constructing a concrete module, comprising the steps of:

forming a first pitch wall and a second pitch wall, each of said first and second pitch walls having a wall upper end and having a pitch wall first lateral end and a pitch wall second lateral end and a wall lower end, such that said pitch wall first lateral ends are each mitered;

forming a linking wall having two linking wall lateral ends, such that said linking wall lateral ends are each mitered;

providing a floor form platform having a horizontal platform upper surface and an upright floor form rail extending upwardly from said platform surface and having a longitudinal rail side;

placing said first and second pitch walls and said linking wall on the horizontal platform upper surface of said floor form platform such that the pitch wall second lateral ends of said first and second pitch walls are each adjacent to said longitudinal rail side and such that the pitch wall first lateral ends of said first and second pitch walls are adjacent to said linking wall lateral ends with said pitch wall first lateral ends and said linking wall lateral ends meeting to define mitered corners and said first and second pitch walls both extending generally in the same direction from said linking wall and are spaced apart from each other, and said first and second pitch walls, said linking wall and said longitudinal rail side of said floor form rail together enclosing a region of said horizontal platform surface to define a floor form;

pouring uncured concrete into said floor form;

permitting the concrete within said floor form to cure and define a module floor joined to said first and second pitch walls and said linking wall, such that said module floor, said first and second pitch walls and said linking wall together define a module;

and removing the completed module from said platform.

3. A method of constructing first and second concrete modules, comprising the steps of:

forming first, second, third and fourth pitch walls, each said pitch wall having a wall upper end and having a first lateral end and a second lateral end, and a wall lower end;

forming first and second linking walls, each said linking wall having two linking wall lateral ends;

providing a floor form platform having a horizontal platform surface and an upright floor form rail extending upwardly from said platform surface and having a first longitudinal rail side and a second longitudinal rail side;

placing said first and second pitch walls and said first linking wall on said platform surface such that the pitch wall second lateral ends of said first and second pitch walls are each abutting and substantially perpendicular to said first longitudinal rail side and the pitch wall first lateral ends of said first and second pitch walls are each adjacent to said first linking wall such that said first and second pitch walls both extend generally in the same direction from said first linking wall and are spaced apart from each other, and said first and second pitch walls, said first linking wall and said first longitudinal rail side of said floor form rail together enclosing a first region of said horizontal platform surface to define a first floor form;

placing said third and fourth pitch walls and said second linking wall on said platform surface such that the pitch wall second lateral ends of said third and fourth pitch walls are each adjacent to said second longitudinal rail side, and the pitch wall lateral end of said third pitch wall is directly opposite the pitch wall lateral end of said first pitch wall and said third pitch wall and said first pitch wall are oriented at substantially the same angle relative to horizontal, and the pitch wall lateral end of said fourth pitch wall is directly opposite the pitch wall lateral end of said second pitch wall and said fourth pitch wall and said second pitch wall are oriented at substantially the same angle relative to horizontal, and the pitch wall first lateral ends of said third and fourth pitch walls are each adjacent to said second linking wall, such that said third and fourth pitch walls both extend generally in the same direction from said second linking wall and are spaced apart from each other, and said third and fourth pitch walls, said second linking wall and said second longitudinal rail side of said floor form rail together enclosing a second region of said horizontal platform surface to define a second floor form;

pouring uncured concrete into said first and second floor forms; permitting the concrete within said first floor form to cure and define a first module floor joined to said first and second pitch walls and to said first linking wall, wherein said first module floor, said first and second pitch walls and said first linking wall together define a first module;

permitting the concrete within said second floor form to cure and define a second module floor joined to said third and fourth pitch walls and to said second linking wall, wherein said second module floor, said third and fourth pitch walls and said second linking wall together define a second module;

lifting the completed said first module off said platform, and lifting the completed said second module off said platform.

4. The method of claim 3, comprising the additional steps of:

forming metal plates into lateral edges of the pitch walls and linking walls;

and welding the adjacent metal plates of adjacent lateral ends together to hold the walls in place prior to floor and roof forming.

5. The method of claim 3, comprising the additional steps of forming a mitered edge along the pitch wall shorter lateral ends forming a mitered edge along each of the linking wall lateral ends, and placing the shorter pitch wall lateral ends adjacent to the linking wall lateral ends such that pitch wall shorter lateral ends and linking wall lateral ends meet to define mitered corners.

6. The method of claim 5, wherein the step of forming a concrete wall includes the sub-steps of providing three wall forms each having a rectangular perimeter wall resting on a platform; placing reinforcing members within the wall forms, the reinforcing members including threaded first reinforcing rods having threaded rod connection ends such that the threaded rod connection ends are exposed; pouring uncured concrete into the wall forms; permitting the concrete to cure and form building walls; removing the building wall from the wall form; and additionally including the step of fastening second threaded reinforcing rods to the threaded rod connection ends of the first threaded reinforcing rods such that the second threaded reinforcing rods extend laterally into the floor form.

* * * * *